BI-FOLD DOOR ASSEMBLY

BACKGROUND OF THE INVENTION

Bi-fold doors are generally known for use in closet and other doorway openings where there is limited space or a desire to save space in front of the doorway opening.

They include two door panels which are hinged together, and are usually used in two sets, with one panel having a relatively fixed pivotal support near one of the jambs framing the doorway and the other of the panels havings its outermost upper and lower corners pivotally retained and guided in track members across the header and sill of the doorway to cause the two panels to be folded flat against each other as they are opened towards one side.

The door panels are provided with the pivot and guide pins and means are provided on the track members to receive and retain the ends of the respective pins in the course of serving their intended purpose.

In installation and use it will be appreciated that the relative ease with which a pair or set of bi-fold doors can be mounted and adjusted for use is very important and in large part is determinate of the popularity and sales potential of the overall product. As a consequence, many different means of pivotal support and guided retention have been proposed for use with bi-fold door assemblies.

The present invention is directed towards improvements in this latter respect which are both simple and therefore easy and inexpensive to manufacture, and which are also relatively easy and trouble-free to use both in the course of first installation and as regards any subsequent adjustments that may be necessary.

SUMMARY OF THE PRESENT INVENTION

The present invention relates to bi-fold door assemblies and principally to the means for providing fixed and guided pivotal support therefore.

In combination with pivot pins and guide pins provided in the bi-fold door panels, pivot pin brackets and slide blocks of a particular design are provided in the upper and lower disposed track members used with the bi-fold doors.

The pivot pin brackets are a single stamping which is bent and formed to provide for track engagement at one end and to receive and carry a pivot pin bushing within the other end. The bracket includes an upper wall that rides on the track and through which the bushing is snap-fitted, and it has a lower wall or foot that carries the lower end of the bushing. As a consequence, the bushing for the pivot pins can be adjusted and set to any position on the track and securely retained where they will best serve their intended function.

The slide blocks are formed to include guide track slots along opposite side edges, for guide track engagement, and to include a guide pin opening therethrough which is formed for snap-lock fitted engagement therewithin. And, such engagement is accomplished, within the slide block openings, by snap-ring or key segments formed therewithin and which are receptive within an annular groove formed near the ends of the guide pins that are received in the openings. The guide pins are engaged with and carried by the slide blocks, which are in turn carried on the flanges of the track members and so float relatively free therewith.

To disengage the guide pins from their slide blocks, the relief slot at the end is spread, as with a screw drover blade, to draw back the locking segments and allow the pins to be withdrawn.

IN THE DRAWINGS

FIG. 11(*a*) is a perspective showing how the slide blocks are spread to release the guide pins.

DESCRIPTION OF THE ILLUSTRATED EMBODIMENT

Figure 2:
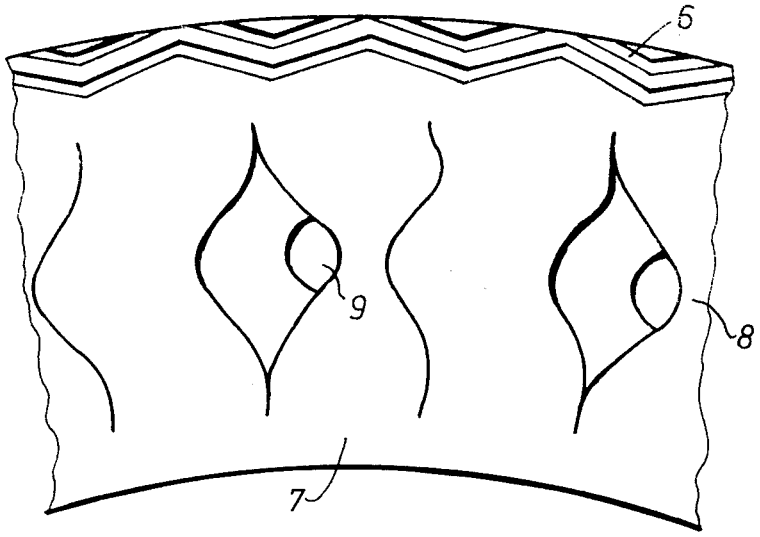
FIG. 2 is an enlarged perspective of pivotal support mounting at the upper corner of the first door panel and, FIG. 3 is an enlarged perspective of the pivotal support mounting at the lower corner of the first door panel.

The bi-fold door assembly of the present invention includes a pair of door panels 10 and 12 which are hinged together at their next adjacent side edges and are of a relative size, height and widthwise, to close part or all of a doorway opening which is framed by the customary header, sill and side wall jambs.

An upper track member 14 is mounted on the header framing the opening and a lower track member 16 is mounted in relative parallel relation thereto across the sill of the opening.

One of the door panels, and in this instance panel 10, is provided with means 18 and 20 at its upper and lower disposed outer corners which serves to provide for fixed pivotal location of the one door panel. The other of the door panels, panel 12, includes means 22 and 24 at its upper and lower disposed outer corners which serves to provide for guided pivotal retension of the second door panel allowing it to be hingedly opened and closed, with the first door panel, and to move relatively down and back the track members 14 and 16 which extend thereover and underneath across the doorway opening in which they are mounted.

Figure 3:
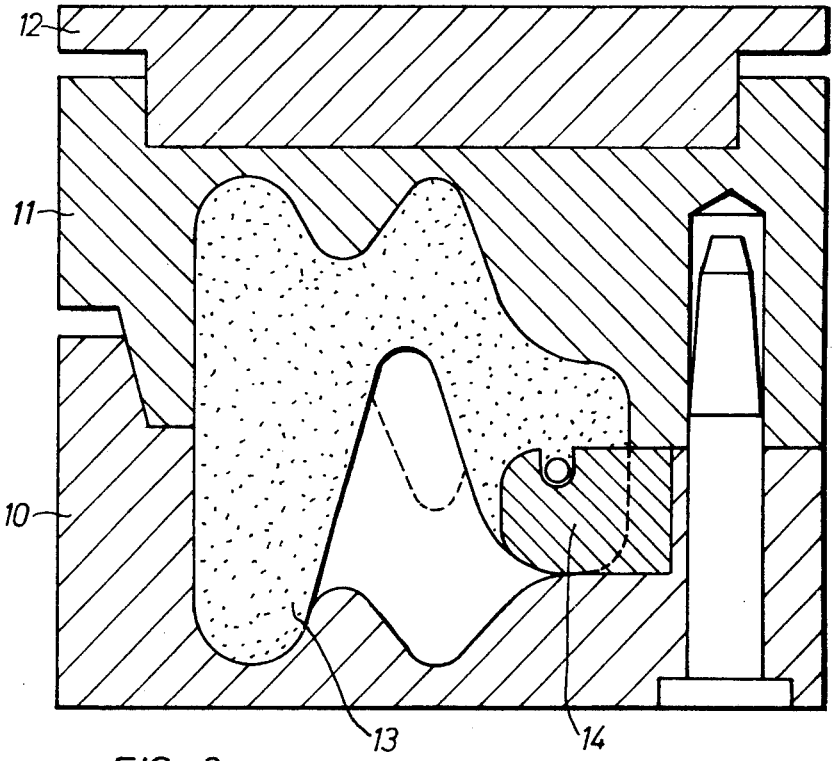
Figure 1:
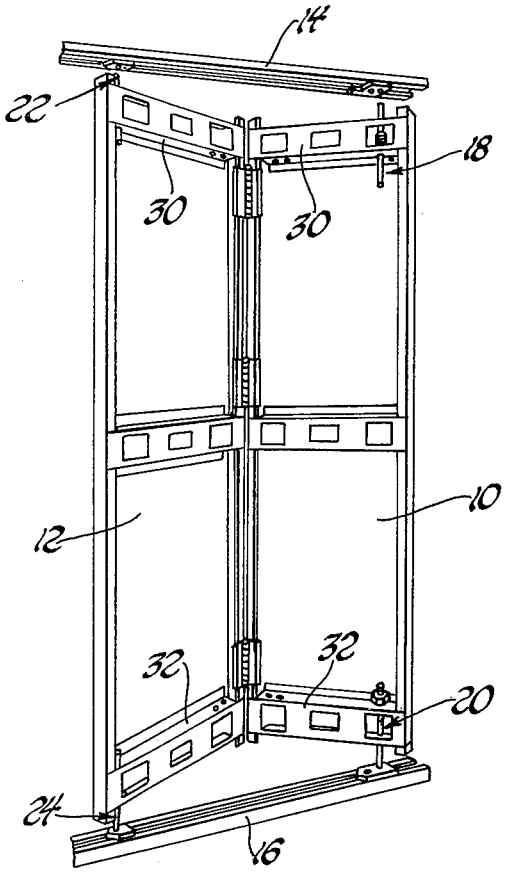
FIG. 1 is a perspective showing a pair of bi-fold door panels and their respective track members as disposed for installation and use in a doorway opening.
Figure 2:
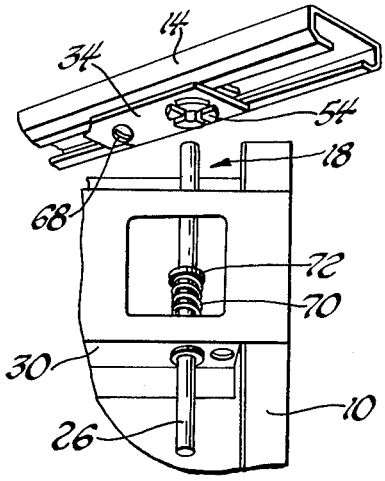
Figure 3:
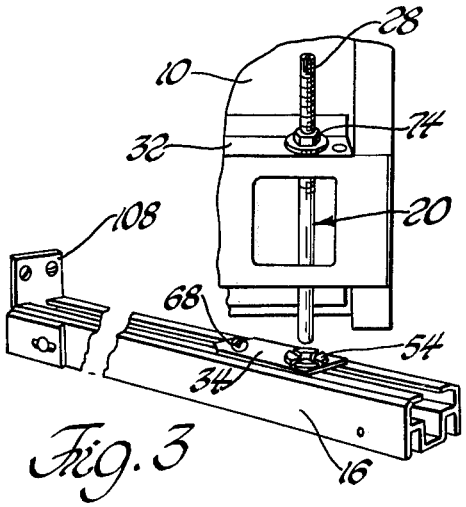
Figure 4:
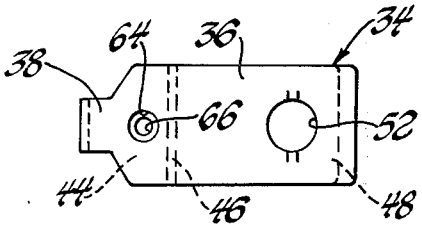
FIGS. 4 and 5 are detail plan and side views, respectively, of the pivot pin brackets.

The means 18 and 20, which provide for the fixed pivotal location of the door panel 10, are best shown in FIGS. 2 and 3. They include pivot pins 26 and 28 which are mounted within the upper and lower framing member 30 and 32, respectively, of the door panel, and which are relatively aligned to provide a pivotal axis for it, and a pair of pivot pin brackets 34, one each on the upper and lower disposed track members, which are receptive of the ends of the pivot pins extended beyond the upper and lower extremities of the door panel.

Figure 7:
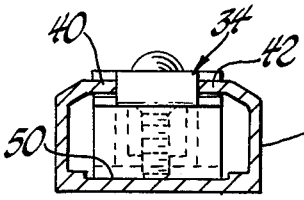
FIG. 7 is a cross-sectional view through a track member and showing a pivot pin bracket provided thereon.

The pivot pin brackets 34 are best shown as mounted on the track members in FIG. 7.

Each bracket is a stamping formed to provide an upper wall or face 36, which rides on top of the track member. It is then narrowed at its inner end to provide a nose 38, which fits between the guide rails 40 and 42 of the track member, and with part 44 bent back under and which is spaced and of sufficient width to be engaged with the underside of each guide rail. A part 46 extends down to a footpiece 48 which rides on the bottom wall 50 of the track member and projects rearwardly under an opening 52 in the upper wall 36 of the bracket within which a pivot bushing 54 is received.

Figure 6:
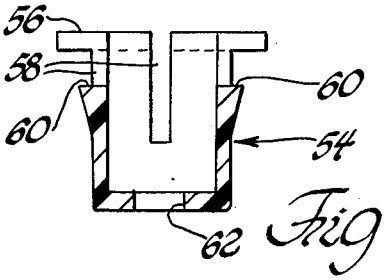
FIG. 6 is an enlarged cross-sectional view of the pivot pin bushing used in the pivot pin brackets.
Figure 5:
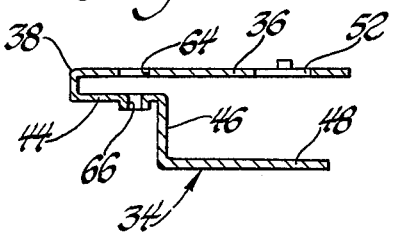

The pivot bushing 54 is shown by itself in FIG. 6 and will be appreciated as being essentially a small plastic cup with a shoulder flange 56, cross cut reliefs 58 and locking shoulders 60 that enable it to be fitted into the bracket opening 52 and retained in engagement with the bracket while having its bottom resting on the foot piece 48. The hole 62 in bottom of the pivot bushing is simply for air bleed and draining purposes when the end of a pivot pin is inserted therewithin.

The pivot brackets 54 are engaged on the track members from their open ends before the track members are mounted on the headers and sills. And, they are relatively adjustable on the track members to any selected location. Aligned openings 64 and 66, through the upper face wall 36 and the reverse bent part 44, the latter of which is tapped or otherwise formed for thread engagement, receive a set screw 68 that is used to fix the location of the bracket, and in turn the pivot bushing 54 which it carries, by causing binding engagement on the guide rails of its respective track member.

Of the two pivot pins 26 and 28, referring back to FIGS. 2 and 3, it will be noted that the pin 26 at the upper end of the first door panel includes a spring 70 and snap ring 72 in a receptive groove that serve to hold and bias the one pin for engagement in the pivot bushing on the upper track member. The other pivot pin 28, at the bottom of the door panel, is threaded at its inner end and engaged with a weld nut (not shown) and fixed in a relative height adjusted position, by a hex nut 74, and thereby serves as a means for setting the door height relative to the track member across the sill as received and bottomed in the lower disposed pivot bushing.

Figure 8:
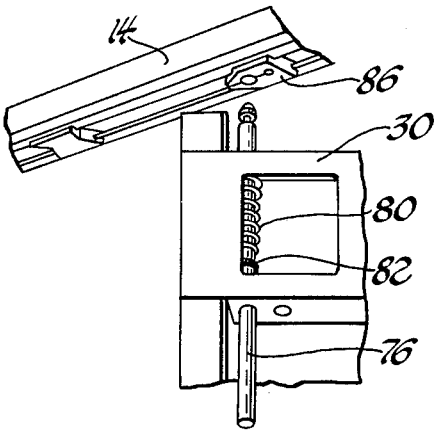
FIGS. 8 and 9 are enlarged perspectives of the guide pin retension means at the outer upper and lower corners, respectively, of the second bi-fold door panel.
Figure 9:
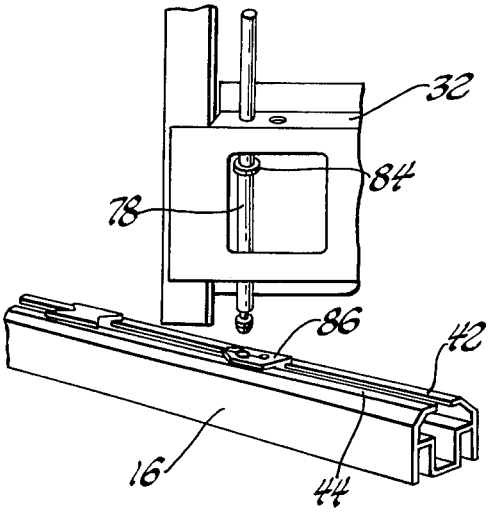

As regards the other door panel 12, the means 22 and 24, which provide for its guided pivotal retension, at its outer disposed corners, are best shown in FIGS. 8 and 9.

Guide pins 76 and 78 are mounted within the upper and lower framing members 30 and 32 of the second door panel and are aligned to provide a second pivotal axis for the two door panels, as used together and in combination. The upper disposed guide pin 76 includes a spring 80 and snap ring 82 in a receptive groove, similar to the pivot pin 26 at the outer upper corner of the first door panel, but which serves to hold and bias it downwardly. The lower disposed guide pin 78, also differs from its counterpart, referring to the pivot pin 28, in that it has a fixed height adjustment, provided by a snap ring 84 in a receptive groove, but is relatively free to extend further downward as may be necessary to maintain guiding engagement on the lower disposed track member.

Each guide pin 76 and 78 is engaged with a slide block 86 on the respective track members 14 and 16.

Figure 10:
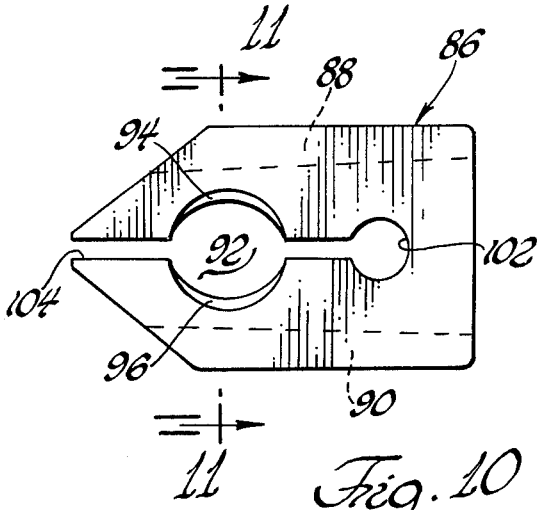
FIG. 10 is a plan view, much enlarged with respect to the other drawing figures, of the slide block.
Figure 11:
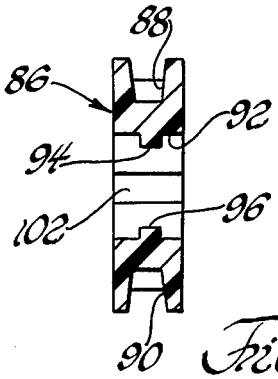
FIG. 11 is a cross-sectional view of the slide block as seen in the plane of line 11—11 in the preceding drawing figure.

As shown in FIGS. 10 and 11, each slide block 86 is a molded plastic member which is formed to include guide track grooves 88 and 90 along its opposite side wall edges, which are in turn receptive of the guide rails 40 and 42 of each track member. An opening 92 is provided through the slide block, between its upper and lower disposed face walls, and is formed to receive and hold the end of a guide pin therewithin.

The slide block opening 92 is of a size, closely matching that of the guide pins and is formed within the opening, from its side walls, to include segments 94 and 96 having a relatively greater radius of curvature but extending into the opening to provide means of locking engagement with the guide pins.

Figure 12:
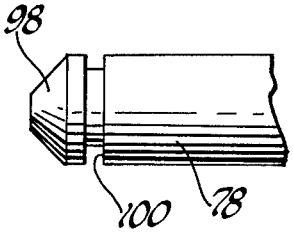
FIG. 12 is an enlarged side plan view of the headed end of a guide pin.
Figure 11A:
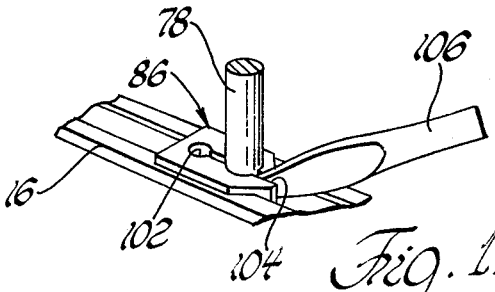

Each guide pin is formed at its end, as best shown in FIG. 12, to include a frustro-conical head 98 and to have a ring groove 100. The slide blocks, as shown in FIG. 10, have the guide pin opening 92 relieved as at 102 and through to one end, as at 104, to enable the guide pins to have their headed ends 98 pressed through and past the restrictions provided by the locking segments 94 and 96.

As is shown and will be appreciated, the guide track grooves 88 and 90 on each side of the slide block taper towards the open slotted end to allow for the press-through fit and the plastic material of which the slide block is made has sufficient yielding resistance to allow the expansion and assure the contraction for the key-lock or snap-ring type retension obtained as the locking segments 94 and 96 line up with the guide pin groove 100.

Both the upper and lower guide pins 76 and 78 are held in engagement with their respective blocks by key or locking segments 94 and 96 engaging in the ring grooves 100 on the pins. In addition, the lower disposed guide pin 78 has shoulder stop bearing support in the lower disposed slide block which provides, in turn, slide support on the lower guide track.

As shown in FIG. 10*a*, with respect to the guide pin 78, a guide pin may be disengaged from the slide block by simple use of a screw driver blade 106 to spread the open end of the slide block and allow the pin to be withdrawn through the pin opening once the locking segments are laterally displaced. And this is relatively easily accomplished, without any hang-up since the spread of the slide block is equalized on both sides by being to the limits afforded by the tapered track grooves on each side.

INSTALLATION AND USE

The upper and lower track members 14 and 16 may be fastened directly to the header and sill, between the jambs framing an opening in which the doors are to be used, or mounting brackets 108, as shown in FIG. 3, may be used. Both track members are provided with the required pivot brackets 34 and slide blocks 86.

To install the doors, the bottom pivot pin 20 is set into the pivot bracket bushing 54 on the lower track member 16 and near one of the jambs. The upper pivot pin 18 is then depressed against its spring 70 and lined up for engagement in the pivot bushing 54 on the upper track member 14. This is most easily accomplished by pulling down on the lower end of the upper pin which is accessible under the upper door panel framing member 30.

Next, the upper guide pin 76 on the other door panel is aligned with the large opening 92 in the slide block 86 on the upper trade member and the pin is pushed up from underneath until it snaps into retained engagement therewith. Then the same procedure is repeated for the lower guide pin 78 with respect to its slide block on the lower track member.

To move the two panels relatively within the doorway opening which they serve, the pivot bracket screws 68 are loosened at the top and bottom so that the brackets can be slid to the desired position, which will be relatively closer or removed from the side jamb framing the opening to provide proper closure at the frame and still allow the pivotal movement without binding which is required.

Height adjustment at the pivotal side of the hinged doors is obtained by loosening the lock nut 74 on the threaded end of the lower pivot pin 20 and turning the pin (which is provided with a screwdriver slot in its upper end) for the desired adjustment up or down. And, thereafter, the lock nut is reset to secure the adjustment made.

No height compensation is necessary at the outer ends of the two hinged door panels. Support, and consequently height adjustment, is provided at the lower pivot pin 20 in the first door panel. Out-of-square adjustment can be made by relative adjustment of the two pivot brackets. And the guide pins 76 and 78 are biased (at the upper one) and free (at the lower one) to maintain their snap-ring engagement with the slide blocks for relatively free guiding retention of the outer edge of the two hinged door panels.

As normally used, in sets of two bi-fold door panels, rubber bumpers as are shown in FIG. 8 are positioned in the upper track member 14 at a center position and so that a modest pressure is applied through slide blocks, to guide pins, to keep the door panels in an overcenter biased closed position, as is commonly known.

The door panels are mounted to open outwardly, hinging at their juncture, and with the outer panel guided to follow the tracks and fold against the inner panel.

I claim:

1. A bi-fold door assembly for use in a doorway opening framed by a header, a sill and side wall jambs, said assembly including upper and lower track members mounted respectively on the header and sill and extending between the side wall jambs, a pair of bi-fold door panels hinged together at next adjacent side edges and of a size to extend between said track members and to close at least part of said doorway opening, means for fixed pivotal location provided between said track members and one of said door panels at the outer disposed upper and lower corners thereof, and means for guided pivotal retension provided between said track members and the other of said door panels at the opposite outer disposed upper and lower corners thereof, said means of fixed pivotal location including axially aligned pivot pins mounted in the upper and lower framing members of said one door panel and pivot brackets receptive thereof and provided on said track members, each of said pivot brackets being adjustable on said track members and each including a pivot bushing and means of fixing the adjusted location thereof, the upper disposed of said pivot pins being axially reciprocal and spring biased for ease of engagement and disengagement with its respective bushing, and the lower disposed of said pivot pins including means for setting the door height relative to said sill track member, said means of guided pivotal retention including axially aligned guide pins mounted in the upper and lower framing members of said other door panel and slide blocks receptive thereof and provided on said track members, and snap-fitted means of retaining engagement provided between said guide pins and said slide blocks (including); said snap-fitted means including having slide blocks (being) formed for track engagement at relatively opposite side edges thereof, an opening provided clear through said slide blocks between opposite faces thereof and receptive of a guide pin therewithin, said guide pins having a tapered headed end formed to be axially received through said slide block openings and including a ring groove provided next adjacent thereto, and means provided within said slide block openings and between the open ends thereof for fitted engagement with said groove and retention of said guide pins to said slide blocks, said openings being relieved at one end of said slide blocks for providing yielding resistance in the extension of the headed end of said guide pins therethrough and snap-fitted engagement of said retention means within said ring grooves.

2. The bi-fold door assembly of claim 1, said ring groove and the retention means within said slide block openings being formed to provide shoulder stop bearing support for the lower disposed guide pin of said other door panel in said slide block and on said guide track therethrough.

3. The bi-fold door assembly of claim 2, said retention means including key segments formed within said slide blocks from the side walls of said openings and to extend therewithin.

4. The bi-fold door assembly of claim 3, said slide blocks being relieved through said one end and having the side edges thereof, which are formed for track engagement, including tapered guide track grooves for the yielding resistance required to receive and release a guide pin into and from snap-fitted engagement therewith.

5. The bi-fold door assembly of claim 4, the relief provided through the one end of said slide block including a slot receptive of a screw driver blade for forcibly spreading said opening and releasing a guide pin engaged therewithin.

6. The bi-fold door assembly of claim 5, said guide pins being outwardly extended for slide block retained engagement and having their opposite ends readily accessible for inward retraction thereof in the disengagement of said pins therefrom.

7. The bi-fold door assembly of claim 1, said pivot brackets including a one-piece stamping bent and formed to provide for track engagement and retention at one end and the receipt and support of a pivot pin bushing of the other end thereof, said one end also including set screw means for track holding engagement fixing the location of said pivot bracket, and snap-fitted pivot pin bushing received in the other end of said brackets and supported wholly thereupon.

* * * * *